US007157681B1

(12) United States Patent
Tetzlaff

(10) Patent No.: US 7,157,681 B1
(45) Date of Patent: Jan. 2, 2007

(54) PHOTOMULTIPLIER TUBE GAIN STABILIZATION FOR RADIATION DOSIMETRY SYSTEM

(76) Inventor: Wolfgang Tetzlaff, 980 SW. Alcora Dr., Pullman, WA (US) 99163-2005

( * ) Notice: Subject to any disclaimer, the term of this patent is extended or adjusted under 35 U.S.C. 154(b) by 0 days.

(21) Appl. No.: 11/295,109

(22) Filed: Dec. 5, 2005

Related U.S. Application Data

(63) Continuation-in-part of application No. 10/737,544, filed on Dec. 16, 2003, now abandoned.

(51) Int. Cl.
*H01J 43/04* (2006.01)

(52) U.S. Cl. ..... 250/207; 250/214 VT; 250/205

(58) Field of Classification Search ..... 250/207, 250/214 VT, 214 AG, 214 LA, 205
See application file for complete search history.

(56) References Cited

U.S. PATENT DOCUMENTS

| | | | | |
|---|---|---|---|---|
| 3,515,878 | A | 6/1970 | Reid, Jr. et al. | |
| 3,925,665 | A | 12/1975 | Robertson et al. | |
| 4,220,851 | A | 9/1980 | Whatley, Jr. | |
| 4,322,617 | A | 3/1982 | Parker | |
| 4,727,253 | A | 2/1988 | Brum et al. | |
| 5,079,424 | A | 1/1992 | Kobayashi | |
| 5,157,250 | A | 10/1992 | Oikari et al. | |
| 5,321,261 | A | 6/1994 | Valenta | |
| 5,548,111 | A | 8/1996 | Nurmi et al. | |
| 5,610,396 | A | 3/1997 | Mattern | |
| 5,715,048 | A | 2/1998 | Taylor | |
| 5,859,429 | A | 1/1999 | Brown et al. | |
| 5,892,234 | A | 4/1999 | McKeever et al. | |
| 5,962,857 | A | 10/1999 | McKeever et al. | |
| 6,087,656 | A | 7/2000 | Kimmich et al. | |
| 6,087,666 | A | 7/2000 | Huston et al. | |
| 6,407,390 | B1 | 6/2002 | Rozsa | |
| 6,518,556 | B1 * | 2/2003 | Staton et al. | 250/207 |
| 6,545,758 | B1 * | 4/2003 | Sandstrom | 356/317 |
| 6,825,479 | B1 * | 11/2004 | Katagiri | 250/484.5 |

* cited by examiner

*Primary Examiner*—Stephone B. Allen
*Assistant Examiner*—Davienne Monbleau

(57) ABSTRACT

Methods and means for measuring and adjusting the gain of a photomultiplier tube (PMT), or other photo-detector with electron multiplication gain, for the purpose of achieving accurate light measurement, such as in a luminescent radiation dosimeter reader. With a PMT illuminated by a light emitting diode or other light source, the PMT output signal is measured in two modes, signal integration and photon pulse counting. The measured PMT gain is calculated as the ratio of the integrated signal to the photon pulse count. The PMT high voltage may be adjusted to cause the measured PMT gain to correspond to an established calibration gain value, or the data from the PMT may be adjusted to compensate the deviation of the measured PMT gain from the calibration gain value. The light source may be a controllable light source that can be adjusted to provide a specific photon count rate output as measured by the PMT. This invention provides for maintaining light measurement calibration without requiring temperature stabilization or a fixed light source.

15 Claims, 7 Drawing Sheets

PHOTOMULTIPLIER TUBE GAIN STABILIZATION FOR RADIATION DOSIMETRY SYSTEM

CROSS-REFERENCE TO RELATED APPLICATIONS

This is a continuation in part of application Ser. No. 10/737,544, filed Dec. 16, 2003, now abandoned.

FEDERALLY SPONSORED RESEARCH

Not applicable.

SEQUENCE LISTING OR PROGRAM

Not applicable.

BACKGROUND OF THE INVENTION

1. Technical Field

This invention relates generally to a method for stabilizing the electron multiplication gain of a photo-detector, such as a photomultiplier tube (PMT), and, more specifically, to the use of such photo-detector stabilization method in a reading device that measures the light emitted from luminescent phosphors, for example as used to determine the level of ionizing radiation to which the phosphor has been exposed.

2. Discussion of Prior Art

Radiation dosimeters are widely used to measure the presence of ionizing radiation. Various radiation dosimeter means and methods are used to detect radiation, and among these are electronic device response, photographic film response, and light emission from luminescent phosphors. The emission of light from luminescent phosphors may be stimulated thermally or optically. When luminescent phosphors are used for radiation dosimetry, the amount of luminescent emission is directly related to the ionizing radiation exposure to which the phosphor has been subjected. Thus to obtain an accurate measurement of radiation exposure, emitted light must be measured accurately.

Thermally stimulated and optically stimulated phosphors are used extensively in radiation dosimeters to monitor radiation exposure levels, and are well known in the art. The mechanism of phosphor response to ionizing radiation and the luminescence that results under thermal or optical stimulation is well understood, and has been described by others, such as Huston et al. in U.S. Pat. No. 6,087,666 and McKeever et al. in U.S. Pat. No. 5,892,234.

When a luminescent radiation dosimeter has been exposed to ionizing radiation, the exposure level can be determined by stimulating the phosphor and comparing the resulting light emission to the light emission obtained for a known radiation exposure. Methods and means of radiation dosimetry utilizing thermally stimulated luminescence and optically stimulated luminescence have been described by others, as described and referenced by McKeever et al. in U.S. Pat. No. 5,962,857.

When used in radiation monitoring badges worn by personnel, luminescent phosphors are typically in the form of individual dosimeter elements, which are comprised entirely or substantially of the luminescent phosphor. To obtain a reading of the radiation exposure which a radiation monitoring badge has received, the individual dosimeter elements are stimulated and the resulting luminescent emission is measured and compared to a calibrated radiation response. This measurement is performed in a luminescent phosphor dosimeter reader that includes phosphor stimulating means and a photo-detector to measure the light emitted by the luminescent phosphor.

Since emitted light levels from luminescent phosphors used for radiation dosimetry are typically very low, the photo-detector used to detect this light must be capable of measuring very low light levels. At the most basic level of operation for an electronic photo-detector, a single photon of light incident on the photo-detector photosensitive material may produce a single free electron for detection. Direct detection of small numbers of electrons is difficult, thus a photo-detector for low light levels typically employs an electron multiplication means to increase the number of electrons to be detected. Such means for electron multiplication are found in detectors for low level light such as a photomultiplier tube (PMT), a micro-channel plate consisting of an array of very small photomultiplier tubes, and an avalanche photodiode (APD). The electron multiplication gain of APDs is on the order of 1000, much lower than that of PMTs which have a typical gain on the order of 1,000,000. Thus a PMT is the preferred photo-detector for low level light detection.

In order to measure the emitted light accurately, a photo-detector must be calibrated, and this calibration must be maintained during photo-detector operation. Stabilizing the photo-detector environment, principally the temperature, is helpful for maintaining calibration. Calibration may also be maintained by measuring the photo-detector performance and correcting or compensating variations. Often both approaches are used in combination to maintain calibration of a light measurement system.

The electron multiplication gain is the primary factor affecting the output response stability of a photo-detector such as a PMT which utilizes electron multiplication, and since this gain is very sensitive to temperature, one of the most common stabilization methods is to maintain the photo-detector at a constant temperature. Photo-detectors are often temperature stabilized for this reason, generally at temperatures below ambient to reduce electronic noise and obtain better performance. The use of a thermoelectric cooler for the temperature stabilization of a PMT is described by Robertson et al. in U.S. Pat. No. 3,925,665. Alternatively, Rozsa in U.S. Pat. No. 6,407,390 presents temperature compensation circuitry that reduces temperature effects without stabilizing the actual temperature of the photo-detector. Other types of environmental mitigation are also used along with temperature stabilization, such as shielding against electrical and magnetic fields.

Calibration is also frequently maintained by a capability to measure photo-detector performance, so that performance variations can be compensated or corrected. Robertson et al. in U.S. Pat. No. 3,925,665 describes the use of a light source to check the sensitivity of a light measurement arrangement and stabilize the gain in a reader for thermoluminescence dosimetry. Brum et al. in U.S. Pat. No. 4,727,253 similarly refers to the use of a reference light source in a thermoluminescent dosimetry system to maintain calibration. A reference light source is used to ensure correct and accurate operation in many light measurement applications, especially where the photo-detector is a PMT. To be effective for this purpose, a reference light source must be stable, with a fixed output intensity and wavelength.

The performance of a photo-detector system is often measured using a reference light source which is inherently stable or is made stable by associated stabilization means. A stable reference light permits the performance of a PMT light measurement arrangement to be checked and adjusted, especially to correct or compensate changes in the PMT gain. The PMT is exposed to the light source and the PMT output signal is measured and compared to the light source calibration value. The PMT gain is then increased or decreased, as necessary, to obtain a measured light source reading that corresponds to the calibration value. Alternatively, light measurement calibration may be performed by applying a correction factor, calculated as the ratio of the light source calibration value to the measured light source reading, to the PMT signal or data.

Two common light sources used as reference sources include a scintillator material activated by radioactive decay particles or high energy photons, and a light emitting diode (LED). Since radioactive decay is not affected by temperature, it can be used with a scintillator to produce a highly stable light source. If the decay particles have high energy, flashes of light containing many photons will be produced. Mattern in U.S. Pat. No. 5,610,396 describes the use of a gamma radiation source incident upon a scintillator to generate light flashes for calibration. In contrast, carbon-14 decay produces individual photons in a scintillator, and Valenta in U.S. Pat. No. 5,321,261 describes the use of a scintillator excited by carbon-14 that is used as a calibration light source. Light sources containing radioactive materials are undesirable, however, because radioactive materials are hazardous, and thus their use is greatly restricted. A scintillator light source utilizing a stabilized ultraviolet source for stimulation is described by Kimmich et al. in U.S. Pat. No. 6,087,656.

A light emitting diode (LED) is very convenient for use as a reference light source. The output level and wavelength of an LED, however, are temperature dependent, and thus the LED must be stabilized in order to be used as a reference light source. To obtain a stable output, an LED reference light typically includes temperature stabilization to obtain a stable LED wavelength, and circuitry to provide closed-loop control of the LED output intensity based on measurement of LED output by a photodiode, or other similar photo-detector used exclusively for measuring the LED output. The use of an LED as a reference light for adjusting gain is described by Kobayashi in U.S. Pat. No. 5,079,424. Taylor in U.S. Pat. No. 5,715,048 claims a stable LED light source for calibration based on the use of a photo cell and feedback control circuitry to stabilize the LED output. Brown et al. in U.S. Pat. No. 5,859,429 describes a similar arrangement as a check source, identifying a blue LED as the source and a photodiode as the detector used to adjust the LED intensity. In some cases LED temperature stabilization may be provided by the PMT temperature stabilization means, since the LED is typically in close proximity to the PMT. Whatley in U.S. Pat. No. 4,220,851 describes the temperature stabilization of an LED light source used to stabilize PMT gain.

The LED light source claimed by Whatley for gain stabilization provides flashes of light. The use of light flashes for calibration from a lamp is described by Ried et al. in U.S. Pat. No. 3,515,878. Light flashes can also be produced by radioactive decay events in a light source containing radioactive material. When gain measurements are performed based on flashes of light, gain adjustment may be based not on the output obtained from a single flash, but on the average output of a number of flashes, or on the distribution obtained from many flashes using a pulse height analyzer, as described by Ried et al. in U.S. Pat. No. 3,515,878 and Parker in U.S. Pat. No. 4,322,617. The output signal obtained from a flash of light consisting of a large number of photons appears as a large pulse. If pulses vary in size due to the intrinsic nature of the flashes and for other reasons, measuring and correcting gain based on a distribution of these pulses, rather than a pulse average, can provide better calibration accuracy.

Gain measurements can be made apart from the use of a reference light source. A method for PMT gain stabilization is claimed by Nurmi et al. in U.S. Pat. No. 5,548,111, in which the gain is calculated as the ratio of the anode current to the photocathode current, and the PMT voltage is adjusted to keep this ratio constant. This is similar to the method of Oikari et al. in U.S. Pat. No. 5,157,250 in which the PMT gain is stabilized by maintaining a constant ratio between the anode current and the first dynode current.

The various means and methods described above for stabilizing the response of a PMT photo-detector are effective to varying degrees and some are widely used. In general, they result in a photo-detector system that is significantly larger, more complex and more expensive than the photo-detector itself, thus restricting the use of these photo-detectors for some applications.

OBJECTS AND ADVANTAGES

It is an object of the present invention to provide a simple method for stabilizing the electron multiplication gain of a photo-detector, preferably a photomultiplier tube, used to measure light, in order to maintain photo-detector system calibration. Such a method can reduce cost, size, weight and complexity of photo-detector systems, and thus permit their use in new applications. This is especially significant in view of recent advances in the miniaturization of PMTs.

It is a further object of the present invention to provide a method for establishing a desired light level from a controllable light source, preferably a light emitting diode, for the purpose of maintaining calibration of a photo-detector system without the use of temperature stabilization means or a separate photo-detector for stabilizing the light source.

It is a further object of the present invention to provide a simple method for stabilizing and maintaining the calibration of the photo-detector used for light measurement in a reading device that measures the light emitted from luminescent phosphors. Thus it is possible to make small, portable, low cost readers for accurately reading thermally or optically stimulated phosphors.

SUMMARY OF THE PRESENT INVENTION

This invention discloses a method, and variations of this method, for stabilizing the gain of a photo-detector, specifically a photo-detector with an electron multiplication gain such as a photomultiplier tube (PMT), and especially as it is applied for use in a luminescent radiation dosimeter reader. However the methods and means described herein are useful in many applications where calibration of a photo-detector for low level light detection must be maintained, and is especially suited for light measurement in systems for which minimizing cost and complexity is of primary importance. The methods of this invention are based on the combined use of two modes of photo-detector output signal measurement, photon counting and signal integration.

The photon counting mode for measuring the light incident on a photo-detector is possible because of the quantum nature of light as discrete photons, which arrive at the photo-detector at distinct points in time. Furthermore, only when a photo-detector preserves the incident photon events as distinct output events can incident photons actually be counted. A PMT is the preferred photo-detector for this purpose, because of its high gain and the high degree to which it preserves the incident photon events in the output signal. At low light levels the output pulses that result from photons incident on the PMT rarely overlap and the pulses can be counted to determine the number of incident photons during a measurement interval with a high degree of accuracy. At high light levels, however, output pulses will frequently overlap and become indistinguishable, so that they cannot be counted accurately. Thus the photon counting measurement mode can only be used at low to moderate light levels.

The second mode for measuring light incident on a photo-detector is signal integration, measuring the cumulative output signal. For a PMT, this is the integral of the PMT output current. The output signal as used for photon counting is further processed by electronic circuits that accumulate or integrate the signal to obtain the cumulative signal during a measurement interval. Although this measurement mode could be performed in succession with the photon counting mode, the preferred approach is to measure the incident light in both photon counting and integrated signal modes simultaneously.

In accordance with this invention, after a photo-detector output has been measured by both photon counting and integrated signal measurement modes, a measured photo-detector multiplier gain is calculated as a ratio, measured integrated signal divided by measured photon counts. The methods further compare this measured value for photo-detector gain to an established calibration gain value. A correction factor, the calibration gain divided by the measured gain, may be used to numerically correct photo-detector data. The preferred approach, however, is to adjust the photo-detector gain if it differs from the calibration gain value.

A further aspect of this invention is that it provides a method for obtaining a fixed light intensity from a controllable light source, preferably an LED, for the purpose of performing a photo-detector gain measurement and gain correction. Photon counting can be less sensitive to photo-detector gain change than signal integration, thus the light source intensity measured as a photon count rate is initially used to set the controllable light source. After measuring and correcting the photo-detector gain based on the initial light intensity, the light source intensity can be measured again and set more accurately. This process can be repeated to set the light source intensity even more accurately. Thus a desired intensity for a light source that is part of a photo-detector system can be obtained without requiring stabilization or an additional photo-detector.

The methods disclosed by this invention are best suited for a PMT, but can be used to correct gain in other photo-detectors which have electron multiplication gain, if such photo-detectors preserve photon events in the output signal and also provide an accurate analog signal that can be integrated and used to determine the multiplication gain.

The measurement of photo-detector gain can be performed at varying light intensities within a range, and need not be performed at a constant light intensity. However, greater calibration accuracy will be obtained by measuring and adjusting the gain at the same light level each time, because of photo-detector light intensity response non-linearity. In photon counting, for example, greater light intensity increases the frequency of overlapped pulses and thus results in more undetected pulses.

The present invention, therefore, determines photo-detector gain from a comparison of integrated signal with photon counts, as obtained from a light source measurement, where the light source is preferably controllable. The preferred method includes setting the controllable light source intensity on the basis of a photon count measurement, calculating the photo-detector gain as the ratio of the measured integrated signal to measured photon counts, and adjusting the photo-detector gain if it is not correct. The method further may repeat the procedure of setting light source intensity and correcting the gain until the correct gain is obtained. In this way any error in setting the light source level due to the effect of gain variation on photon counting will be eliminated as the gain is corrected.

BRIEF DESCRIPTION OF THE DRAWINGS

Preferred embodiments according to this invention are illustrated in the accompanying drawings, in which.

DRAWING REFERENCE NUMERALS

Figure 1:
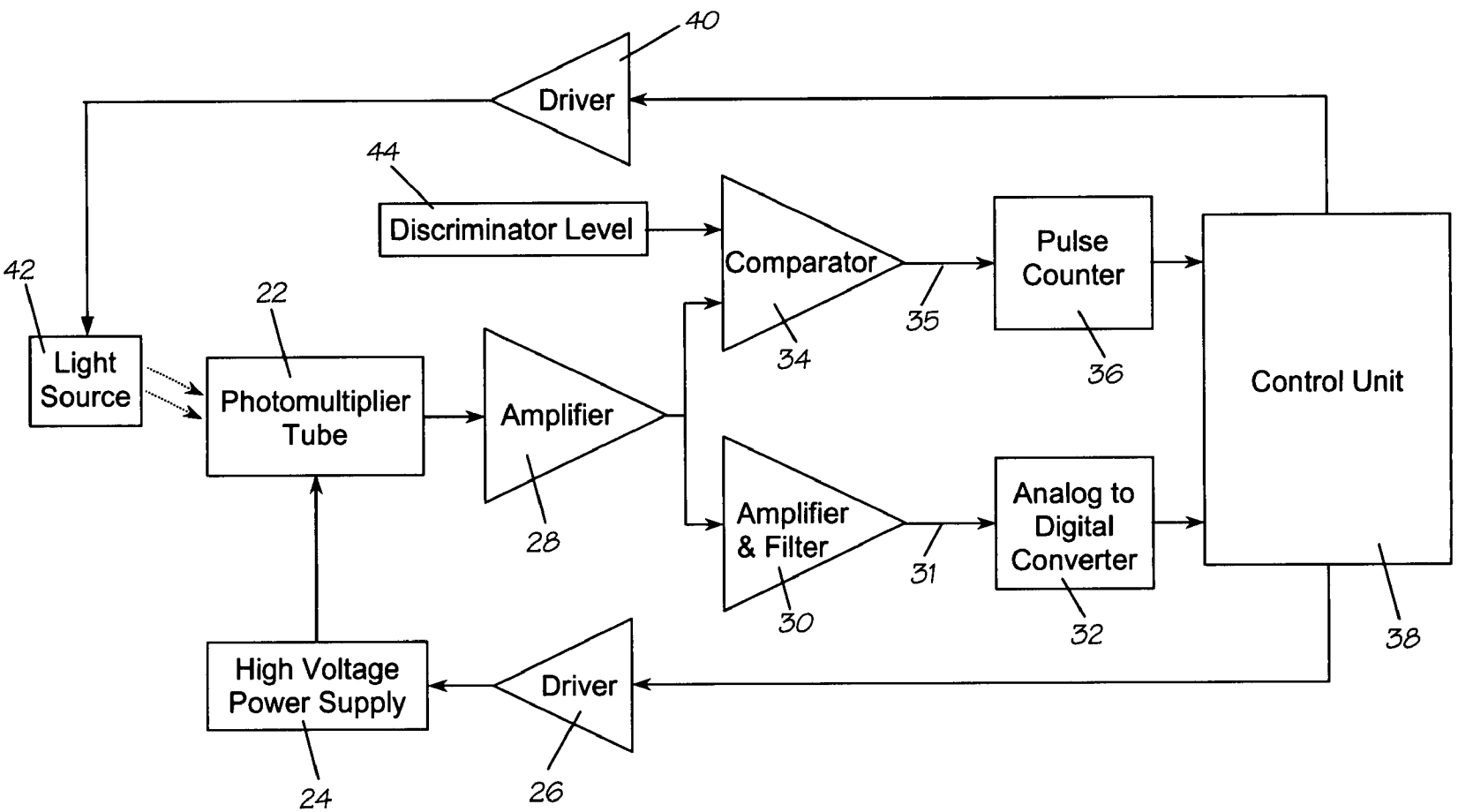
FIG. 1 presents a block diagram of electronic circuits for the gain stabilization methods of this invention, comprising an amplifier, a discriminator level, a comparator and a counter for photon counting, an analog signal processing and integrating means, a control unit, and drivers for the light source and the PMT high voltage.

22 Photomultiplier tube
24 Controllable high-voltage power supply
26 High-voltage power supply driver
28 Transimpedance amplifier
30 Low-pass amplifier
31 Analog signal
32 Analog-to-digital converter
34 Comparator
35 Photon count pulses
36 Pulse counter
38 Control unit
40 Light source driver
42 Light source
43 Threshold discriminator voltage level
44 Line representing a pulse discriminator level
46 Noise pulse distribution
48 Signal pulse distribution
50 Combined pulse distribution

52 Signal pulses detected as a function of discriminator level
54 Noise pulses detected as a function of discriminator level
56 A specific discriminator level
58 Noise pulses detected at discriminator level 56
60 Signal pulses detected at discriminator level 56
62 Low gain pulse distribution
64 High gain pulse distribution
66 Normalized photon count response as a function of normalized PMT gain
68 Normalized integrated current response as a function of normalized PMT gain
70 Measure dark current and dark counts
71 Turn on LED
72 Measure light from LED by PMT as a photon count and a current integral
73 Compare photon count to desired photon count value
74 Increase LED drive if photon count is low
75 Decrease LED drive if photon count is high
76 Compare current integral to desired current integral value
77 Increase PMT gain if current integral is low
78 Decrease PMT gain if current integral is high
79 Turn off LED
80 Compare current integral to photon count ratio with calibrated value for PMT gain
81 Increase photo-detector gain if current to photon ratio is low, and turn off LED
82 Decrease photo-detector gain if current to photon ratio is high, and turn off LED

DETAILED DESCRIPTION OF THE PREFERRED EMBODIMENTS

FIG. 1 presents a simplified block diagram illustrating preferred electronic circuits for performing photo-detector gain stabilization in accordance with the methods of this invention. The photo-detector includes a photon to electron conversion means and an internal electron multiplication means. A preferred photo-detector is photomultiplier tube 22.

Photomultiplier Tube Characteristics and Operation

A photomultiplier tube (PMT) has a photosensitive portion, called the photocathode, which receives incident light and from which electrons are emitted primarily as a result of the energy imparted to the photocathode by incident light photons. Not every photon striking the photocathode will cause an electron to be emitted. The percentage of incident photons that cause the emission of an electron is called the quantum efficiency, which varies with the wavelength of the incident light.

A PMT also has an electron multiplier that is comprised of a series of conductive surfaces referred to as dynodes. An electrical potential or voltage is applied between the photocathode and a first dynode to establish an electric field that causes electrons emitted from the photocathode to be accelerated toward the first dynode. The acceleration of an electron by the electric field between the photocathode and first dynode increases the kinetic energy of the electron, and this kinetic energy is imparted to the first dynode upon impact of the electron with the dynode surface. The energy thus imparted typically results in the emission of several electrons from the dynode. Voltages applied to the second dynode and subsequent dynodes establish an electric field that accelerates electrons from the first dynode toward the second dynode, and then successively toward each subsequent dynode. Each electron emitted from the first dynode imparts energy to the second dynode upon impact with the surface, typically causing several electrons to be emitted from the second dynode for every electron emitted from the first dynode, thus resulting in electron multiplication. As this process is carried on to subsequent dynodes, the number of electrons emitted from each dynode becomes very large. An anode is placed after the last dynode with an electric potential that collects all the electrons emitted from the last dynode, and these electrons constitute the output current of the PMT. Since the charge of an electron is negative, the electric potential of the first dynode must be more positive than the photocathode, and each subsequent dynode must be more positive than the preceding dynode, and the anode must be at the most positive potential. A typical photocathode potential is 1000 volts more negative than the anode, with a less negative potential on the first dynode, and each successive dynode at a less negative voltage than the preceding dynode. The multiplication gain for each dynode stage is typically about 4, so that a ten dynode PMT has a typical multiplication gain of about 1,000,000, which means that one electron emitted from the photocathode produces, on average, a million electrons at the anode output of the PMT.

The amount of light incident on a PMT photocathode can be determined by measuring the total current from the PMT anode, that is, integrating the anode current during a measurement interval. Since the response of a PMT is linear over a wide range of light intensity, the level of incident light can be determined by a comparison of the measured output to the output obtained for a known light level.

The amount of light incident on a PMT photocathode can also be determined by counting pulses on the PMT anode output. This is referred to as photon counting, since these pulses result from individual photons causing single electrons to be emitted from the photocathode that are multiplied to produce a pulse consisting of many electrons. These pulses are very short, for example a duration of less than 10 nanoseconds. However quite often electronic circuits with limited high frequency response cause the pulses to broaden. Since the arrival of photons is random, two photons may be incident on the PMT photocathode at nearly the same time. Thus PMT output pulses will sometimes overlap and become indistinguishable, so that some pulses will not be counted. The error due to uncounted pulses increases as light intensity increases and pulses become more frequent. Thus measuring light accurately by counting pulses is limited in range, for example to light levels below a million photons per second. Nevertheless, a light level within this range can be determined simply by comparing a photon count measurement of the light level to the photon count obtained for a known light level. Methods and means for performing photon counting are well understood in the art and are widely used.

The output pulses from the PMT due to photons striking the photocathode are not identical in size, but actually have a wide variation in size due to the statistical nature of the process by which secondary electron emission occurs. If the average PMT pulse size is one million electrons, there will be many pulses that have a factor of ten more electrons and pulses with a factor of ten less electrons than this average pulse size.

Another measurement consideration is that there are pulses generated in a PMT which are not due to light, and thus contribute an error to a light measurement. These noise pulses originate from several processes. Some electrons are emitted from the photocathode and the dynodes because of thermal energy, an effect that increases with increased temperature. Electrons may also be released when impurity gases in the PMT are ionized due to the high electrical potentials in the PMT. Electrons are also released when high energy particles or cosmic rays are incident on the PMT. Noise pulses from electrons emitted from the photocathode typically appear the same at the PMT output as pulses originating from photons and cannot be distinguished. However pulses originating at dynode stages have less multiplication and thus are generally smaller and can, to a degree, be distinguished in the case of photon counting. Setting a discriminator level that represents a threshold for pulse size allows pulses smaller than the threshold to be ignored, and only pulses larger than the threshold to be counted. PMT noise pulses are counted with the PMT in darkness, and these noise counts, or dark counts, are then subtracted from photon count light measurements to compensate the dark counts that are present in any light measurement. Similarly, with the PMT in darkness, the noise pulses can be measured as a current, designated as the dark current. Subtracting the measured dark current integral from a light measurement current integral compensates this measurement error. Thus PMT dark noise can be compensated in both measurement modes, photon counting and current integration.

Figure 2:
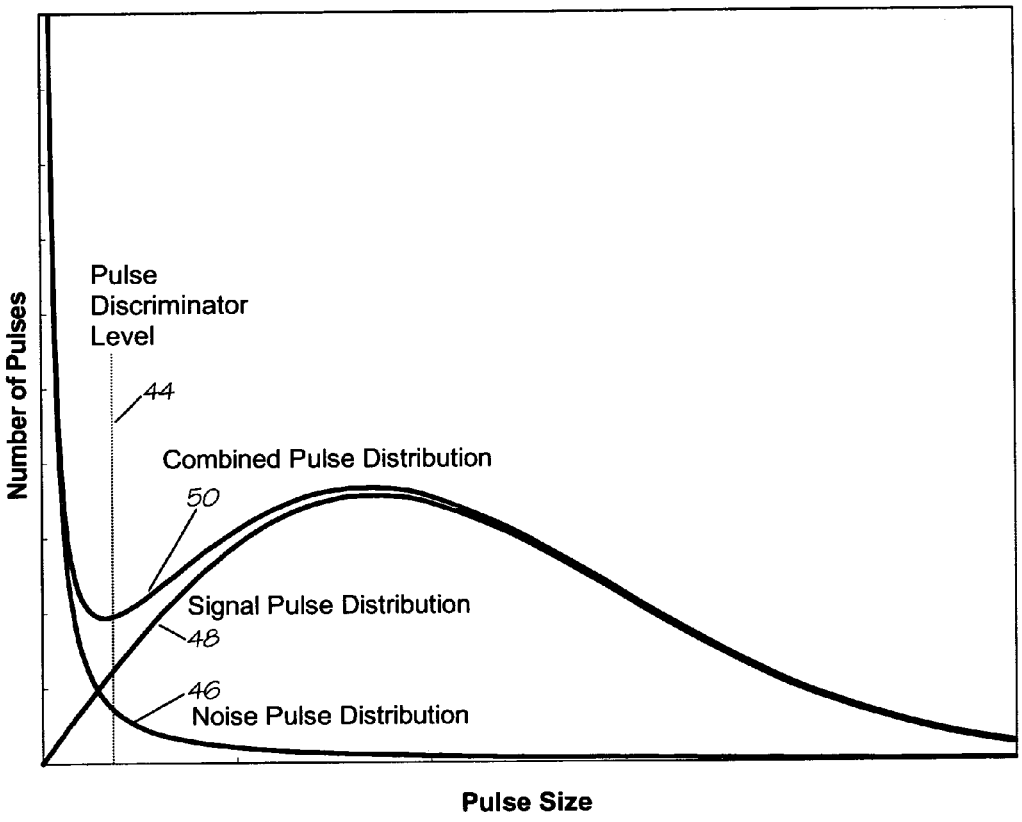
FIG. 2 illustrates the size distribution of PMT output pulses for noise, for photons, and for photons and noise combined.

FIG. 2 presents a plot illustrating PMT output pulse size distributions for a photon signal and for PMT noise pulses. Shown are signal pulse distribution 48 and noise pulse distribution 46, and these are added to form combined pulse distribution 50. Line 44 represents a pulse discriminator level that illustrates the rejection of most noise pulses, to the left of line 44, and the inclusion of most signal pulses, to the right of line 44.

Figure 3:
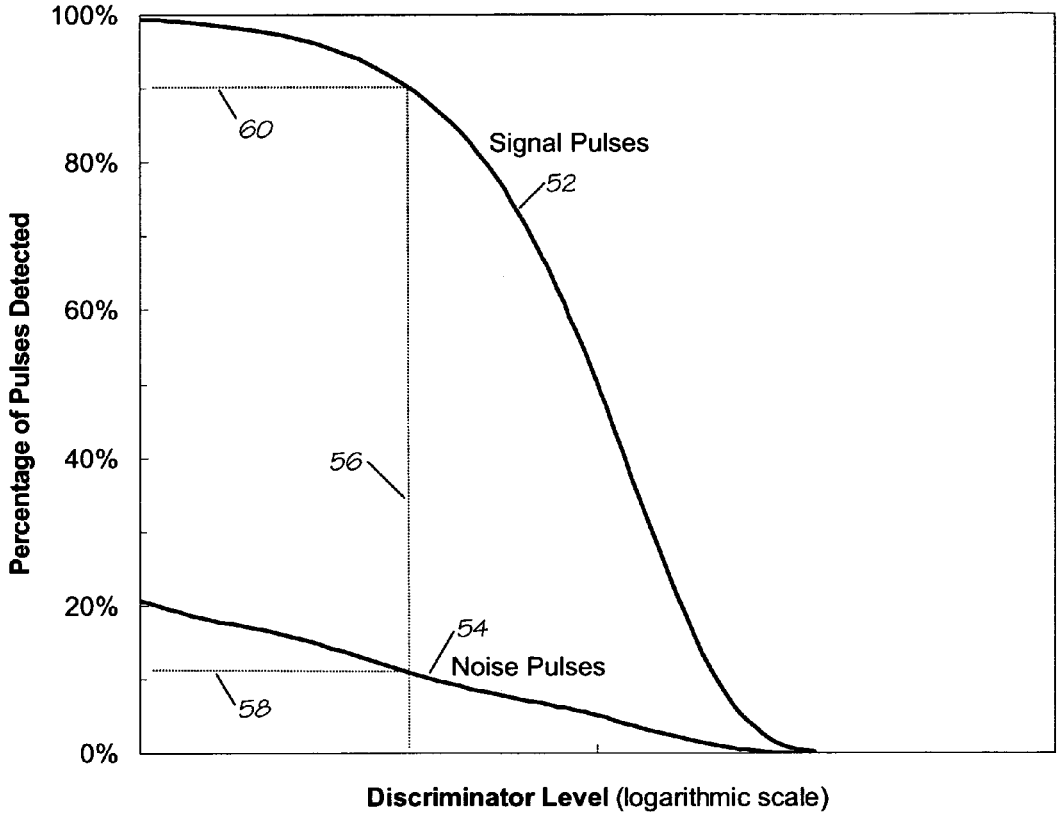
FIG. 3 illustrates the proportion of noise and photon pulses detected as a function of discriminator level for a fixed PMT gain.

FIG. 3 is a plot illustrating the proportion of pulses detected, shown as a percentage on the vertical axis, as a function of the discriminator level on the horizontal axis, which has a logarithmic scale. Shown are the signal pulses detected as a function of discriminator level 52 and noise pulses detected as a function of discriminator level 54. As the discriminator level is reduced, more signal pulses 52 are counted, approaching 100%, but the noise pulses 54 counted also increases and the ratio of signal to noise declines. A specific discriminator level 56 results in noise pulses detected 58 of 11% and signal pulses detected 60 of 90%.

A further consideration of the characteristics of a PMT addresses the objective of this invention, the stabilization of the PMT gain. For an incident electron, the average number of electrons emitted by a PMT dynode varies with temperature, increasing as the temperature is raised and decreasing as the temperature is lowered. However the process of electron multiplication means that whatever this effect is for one dynode, multiple dynodes results in a multiplication of the effect. For example, a 1% increase in the single dynode gain would result in an increase in gain for a ten dynode multiplier of more than 10%. The primary stabilization required for a PMT is the stabilization of the multiplier gain.

As the PMT multiplier gain increases or decreases, the output current scales directly with the gain, that is, a 10% increase in gain will result in an output current that is 10% higher. If output pulses resulting from incident photons are observed, the pulses will likewise be 10% larger.

Figure 4:
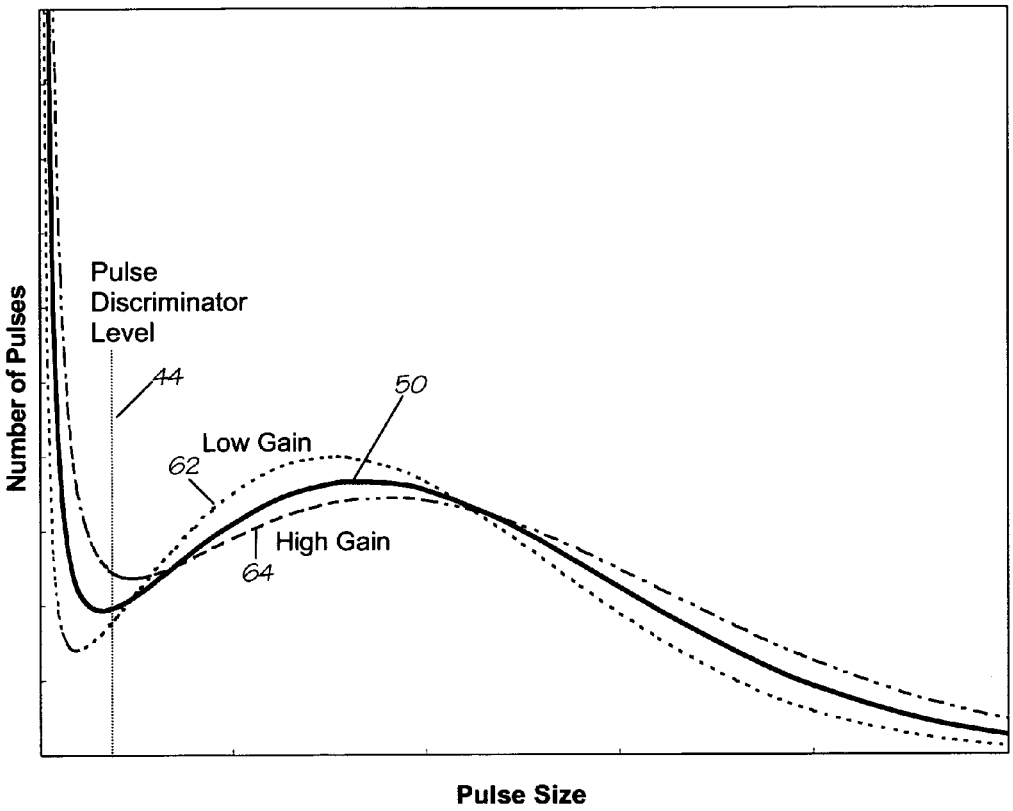
FIG. 4 shows how an increase or decrease in PMT gain changes and shifts the PMT output pulse size distribution, particularly in relation to a fixed discriminator level.

FIG. 4 presents a plot illustrating how PMT output pulse size distributions are affected by changes in gain. Combined pulse distribution 50 is the same as shown in FIG. 2. If the PMT gain is reduced, low gain pulse distribution 62 results, and if the PMT gain is increased, high gain pulse distribution 64 results. If a fixed discriminator level is used, as illustrated by line 44, then an increase in PMT gain resulting in larger pulses will cause more pulses to be counted, and a decrease in PMT gain resulting in smaller pulses will cause fewer pulses to be counted. However if the discriminator level is set at a point to the left of the peak at a low point in the distribution as shown, the effect of the PMT gain change on the pulses counted can be much smaller than the actual gain change. For example, a 10% change in gain may result in only a 1% change in the photon count.

Figure 5:
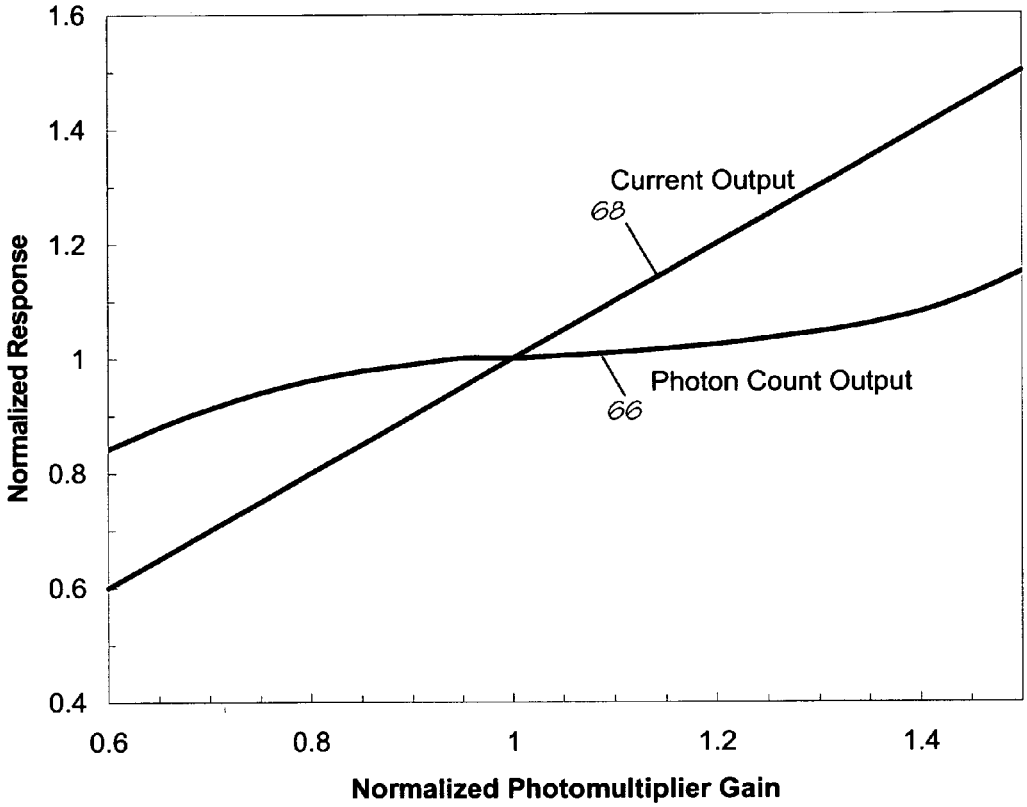
FIG. 5 illustrates the effect of PMT gain change on the integrated analog output and on the photon count output, where responses have been normalized for comparison about a preferred point of operation.

FIG. 5 illustrates the greater gain stability that can be obtained with photon counting, a characteristic employed to advantage by the methods of this invention to stabilize the PMT gain. The plot in FIG. 5 is normalized about a preferred operating point representing a calibrated condition, and shows the normalized photon count response 66 and normalized integrated current response 68 as a function of normalized PMT gain.

In accordance with the methods of this invention, the illustrated lower gain dependence of photon counting is advantageous in setting the controllable light source intensity to a specific intensity level for PMT calibration more accurately than if the integrated current signal were used. This initial light level is used to measure the PMT gain and correct any gain deviation from a calibrated value. If greater accuracy is desired, the light source level can be set again with the PMT gain corrected, and the PMT gain measurement and correction repeated. In this way, both the light source level and the PMT gain can be accurately established.

Photo-Detector Signal Processing

The block diagram of FIG. 1 further shows how the PMT operation and signal processing is performed in accordance with the preceding description. Photomultiplier tube 22 is supplied with a high voltage for operation by controllable high-voltage power supply (HVPS) 24. The output signal of PMT 22 is received by transimpedance amplifier 28, which has a high frequency response. As a transimpedance amplifier, amplifier 28 converts the current signal from PMT 22 to an output voltage that is proportional to the input current. A typical transimpedance gain for amplifier 28 may be advantageously in the range of 1000 to 10,000 volts per amp. A high frequency response, preferably greater than 1 MHz, is desired so that the output voltage substantially preserves the narrow shape of the input current pulses that appear at the anode as a result of individual photons incident on the light sensitive photocathode of PMT 22.

The output of amplifier 28 is directed to two different groups of circuits, one for counting pulses from incident photons and the other for accumulating a measure of the PMT current. Comparator 34 receives the voltage representation of the PMT current pulses from amplifier 28 and compares this with threshold discriminator voltage level 43 and generates a digital output pulse whenever the output of amplifier 28 increases and exceeds the discriminator voltage level. The comparator may include further amplification and circuitry to enhance performance, such as filtering to remove low frequency components of the signal, and other techniques well-known in the art. A pulse counter 36 receives photon count pulses 35 from the output of comparator 34. The output of counter 36 is provided to control unit 38, preferably microprocessor based circuitry, which determines the total number of photons in a measurement interval based on the data obtained from the counter.

The output of amplifier 28 is also provided to analog signal processing circuitry, low-pass amplifier 30, producing analog signal 31 that provides a measure of the integrated PMT output current. Various methods of signal integration are known to the art, but the preferred technique as indicated is the use of analog-to-digital converter (ADC) 32 which provides a digital representation of the low-pass filtered current level to control unit 38, which stores the data and accumulates a sum representing the current integral over the measurement interval. Since an ADC typically cannot capture the high frequency characteristics of the PMT output current signal, high frequencies are removed by a low-pass filter in order to obtain an accurate measurement. Furthermore, the ADC sampling frequency, the number of readings per second, must be higher than the signal frequencies in analog signal 31.

FIG. 1 also shows light source 42, which is preferably a controllable light source such as a light emitting diode (LED). When directed by control unit 38, light source driver 40 provides power to light source 42, causing it to emit light and illuminate PMT 22. If light source 42 is a controllable light source, its intensity is set by driver 40, as directed by control unit 38. In accordance with the preferred methods of this invention, control unit 38 establishes they light source intensity level on the basis of a comparison of the photons counted in a measurement interval with an established calibration value, increasing the light source drive if the measured intensity is low or decreasing the light source drive if the measured intensity is high.

On the basis of the photon count and analog data received by control unit 38, a measure of the total light in a measurement interval is determined as a photon count and as a current integral. From this a measured PMT gain is calculated as the current integral divided by the photon count. In accordance with the methods of this invention, control unit 38 establishes the output voltage of HVPS 24 by means of high-voltage power supply driver 26. If the measured PMT gain is less than an established calibration gain value, control unit 38 increases the PMT gain by increasing the output voltage of HVPS 24, and conversely if the measured PMT gain is greater than the established calibration gain value, control unit 38 decreases the PMT gain by decreasing the output voltage of HVPS 24. The PMT gain is an exponential function of the voltage supplied by HVPS 24.

Techniques for implementing HVPS driver 26 and light source driver 40 are well-known in the art, and preferably include a digital-to-analog converter (DAC) to provide an analog control voltage for the driver output.

Gain Measurement and Adjustment

Figure 6:
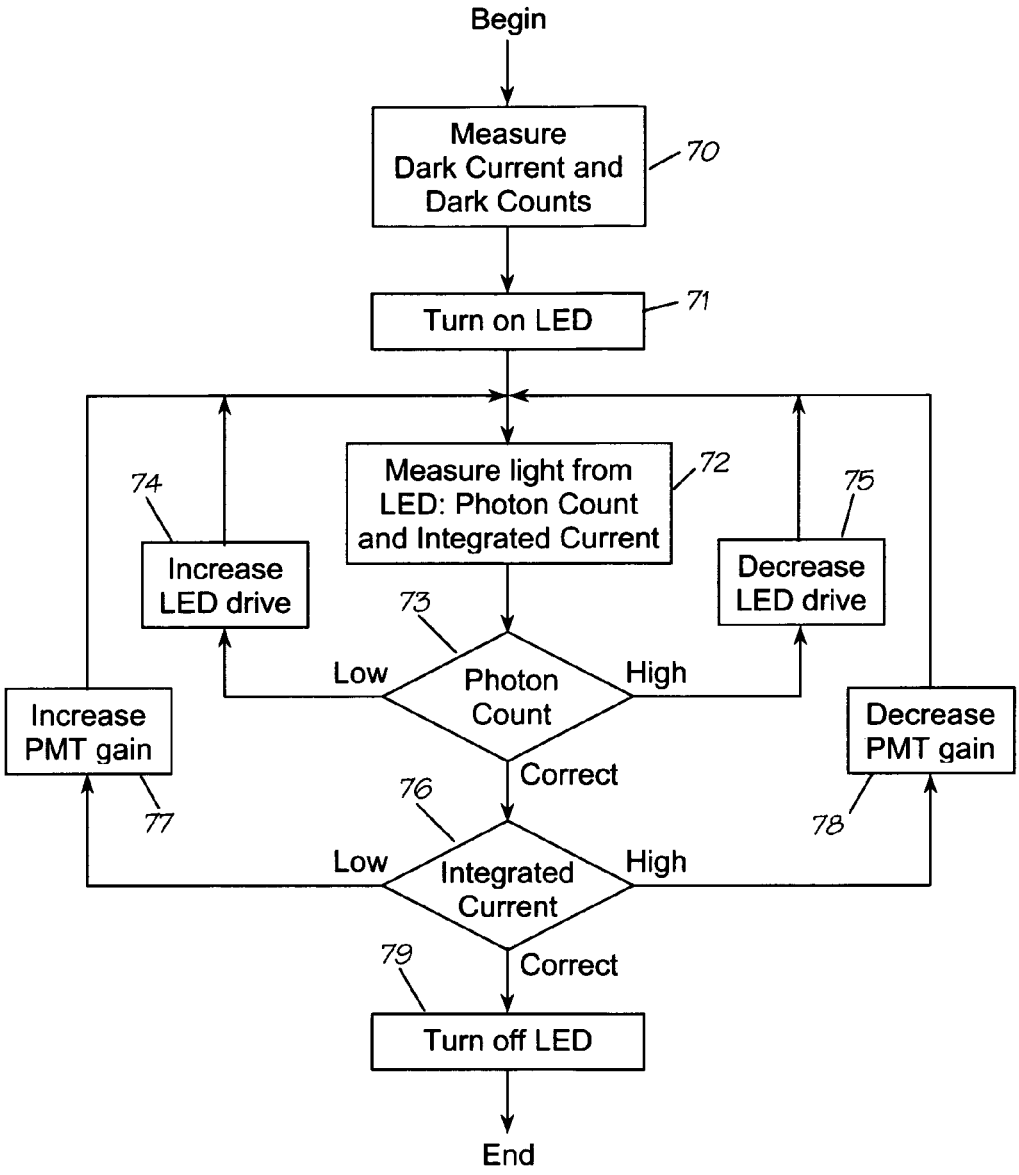
FIG. 6 presents a procedure for adjusting the PMT gain, in accordance with this invention, by measuring and adjusting light from an LED using the photon count output and then adjusting the PMT gain based on the measured current.

FIG. 6 presents a method of this invention as a diagrammed procedure. Prior to gain stabilization, the dark counts and dark current are measured 70, if subsequent light measurements are to be corrected for dark signal. The LED light source is turned on 71, and light from the LED is measured by the PMT as a photon count and a current integral 72. The photon count is then compared to a desired photon count value 73, and if it is low the LED drive is increased 74, if it is high the LED drive is decreased 75, or if it is correct the method advances to similarly compare the measured current integral to its desired level 76. If the current integral is low, the PMT gain is increased 77, if the current integral is high the PMT gain is decreased 78, or if the current integral is correct the LED is turned off and the calibration is complete. In the cases where the LED drive is changed or the PMT gain is changed, the procedure returns to the light measurement block 72, repeating the steps until the correct values for photon count and measured current are obtained.

For the steps in the above procedure where a change is made to the LED drive or the PMT drive, the preferred implementation provides that the amount of change or size of adjustment will have a relation to the amount of deviation of the measured values from a correct value, so that a larger deviation will result in a larger adjustment and a smaller deviation will result in a smaller adjustment. As a practical matter, there must also be tolerances associated with the correct photon count or gain value that is to be achieved, and thus it may be desirable to specify the correct value as a range with an upper and lower limit, so the procedure can be performed more efficiently. The dark signal correction is not explicitly indicated, but if it is performed, it occurs in conjunction with measurement 72. If the dark signal is small enough, for example less than 1% of the light signal, correction for dark signal may not be needed.

Figure 7:
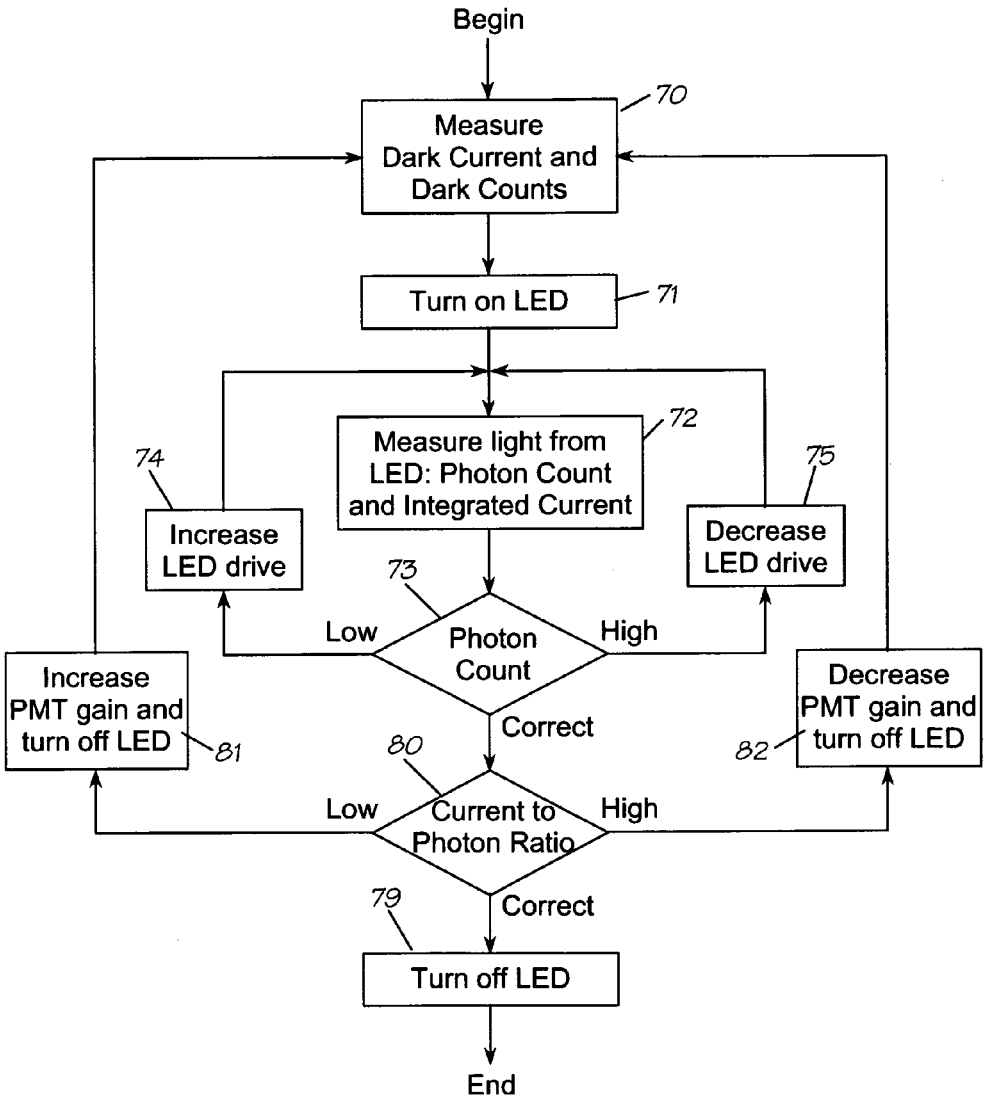
FIG. 7 presents an alternate procedure for adjusting the PMT gain, in accordance with this invention, in which the PMT gain is adjusted on the basis of the current to photon ratio, and in which the dark signal is checked after adjusting the PMT gain and before repeating the adjustment procedure.

FIG. 7 presents an alternate method showing some possible variations in the methods of this invention. In this alternate method, a dark signal correction for light measurements is always performed, and is repeated when the PMT gain is changed. The LED is turned on, the light is measured by the PMT as a photon count and an integrated current, and a desired LED intensity is established, in the same way as described for FIG. 6. The method of FIG. 7 next calculates the current integral to photon count ratio and compares this to the calibrated value for PMT gain 80, to determine if a PMT gain adjustment is needed. If the ratio is high the PMT gain is decreased and the LED is turned off 81. If the ratio is low the PMT gain is increased and the LED is turned off 82. With the LED off, the dark signal measurement is repeated before the adjustment part of the procedure is repeated. When the PMT gain is correct, within a specified tolerance of the calibrated value of the PMT gain, the LED is turned off 79 and the procedure is complete.

Note that the procedure in FIG. 6 could also be modified to use the current to photon ratio instead of measured current, replacing block 76 in FIG. 6 with block 80 from FIG. 7. There are also numerous variations of these described methods that are possible, as may be evident to the reader, that are within the scope of this invention.

Note also that the methods can be applied to a photo-detector other than a PMT, such as a multi-channel plate or an avalanche photodiode. Likewise, the controllable light source may be of a different type than the LED, such as an incandescent lamp or a phosphorescent illuminator.

As described earlier, the methods of this invention requires a light source intensity level that is low enough, preferably below 1,000,000 photon counts per second, so that photon counting can be used. However the light source must also emit enough light, preferably at least 100,000 photon counts per second, so that enough photons can be measured in a short enough time interval, preferably less than ten seconds, so that the statistical error is low, for example less than 0.1% standard deviation, so that it does not significantly affect the accuracy of the measurements. Since the light source level is controllable and the photons are counted, the desired photon count rate is easily established by the means of this invention. Once the gain adjustment is made and the calibration gain value is achieved, the calibration is valid for and applies to the entire measurement range of the photo-detector.

The measurement of dark signal, both dark current and dark counts as referred to earlier and indicated in FIGS. 6 and 7, is performed so that the dark signal component that is a part of any measured light signal can be subtracted, to correct the error in the gain measurement that would otherwise arise due to the dark signal. In a preferred implementation of the method of this invention, the dark current is advantageously small enough that it does not significantly affect the accuracy of the light measurements, so that it can be ignored, except to verify that it is below a prescribed level. However if the dark signal is large enough that it must be corrected, then the dark current integral corresponding to the interval of the light measurement is simply subtracted from the current integral obtained for the light measurement. Similarly, the dark counts corresponding to the interval of the light measurements are subtracted from the photon counts obtained for the light measurement. Photon counting already excludes most of the small pulses associated with dark signal, and subtracting the dark counts removes the entire dark signal from the light measurement photon count, just as subtracting the dark current integral removes the entire dark signal from the light measurement current integral. Although the average dark signal is removed, a disadvantage of a dark signal correction is that the error associated with the dark signal measurement is added to the error of the light measurement. Thus it is advantageous to establish conditions for these methods in which the dark signal can simply be ignored, and need not be measured except for diagnostic purposes.

The methods of this invention are for maintaining a light measurement means in a calibrated condition, especially as incorporated into an instrument or system. This requires that an initial calibration of the light measurement means must first be established, so that this calibration can be maintained by a method of this invention. The initial calibration is typically performed with a highly accurate reference that represents a known quantity to which subsequent measurements are to be compared and in which terms measurements are reported. For example, a radiation dosimetry reader may be exposed to a light level corresponding to a known radiation dose, so that subsequent light measurements can be reported as a radiation dose of relative size to the calibration dose level.

On the basis of this initial calibration, typically performed by a manufacturer, parameters required for a method of this invention are established, specifically, a discriminator level for photon counting, an intensity level for the controllable light source in terms of photon counts, and a photo-detector calibration gain value defined as a light source current level for a fixed photon count level, as illustrated in FIG. 6, or as the ratio of measured current to measured photons for the light source, as illustrated in FIG. 7. Initial power-on parameters for controlling the light source and photo-detector would also be determined, so the gain stabilization can be performed most efficiently. These parameters would be retained for operation of the gain stabilization method, for example, within control unit 38 in FIG. 1.

The light source measurement interval and measurement tolerances, and algorithms to adjust light source intensity and photo-detector gain, are design parameters determined on the basis of the requirements of the application, and which also depend on the specific characteristics of the light source, the photo-detector and associated electronic circuits.

The methods of this invention preferably utilize a light emitting diode as a controllable light source, but may also utilize other types of fixed or controllable light sources. The operation of these methods do not depend on the wavelength of the light source, since only the multiplication gain is measured. In practice, however, the wavelength of the light source is preferably chosen to be representative of the light to be measured, and to meet the needs of the application. The methods of this invention do not require a stable light source, but can obtain a stable light output from a controllable light source by procedures as described herein.

The photo-detector that may be stabilized by this invention is a photo-detector with an internal electron multiplication gain, preferably a photomultiplier tube. Gain stabilization is achieved by measuring and adjusting the gain based on light from a light source, preferably a controllable light source. Electronic circuits are used to measure the photomultiplier tube output under illumination by the light source by two measurement modes, photon counting and current integration. The gain is determined by dividing the current integral obtained from the light source measurement by the photon counts obtained from the light source measurement.

I claim:

1. A method for measuring the electron multiplication gain of a photo-detector utilizing a light source, the method comprising measuring light from said light source by said photo-detector using photon counting and current integration measurement modes to obtain both a photon count and a current integral, and calculating said electron multiplication gain as a ratio of said current integral to said photon count.

2. The method of claim 1 wherein said photo-detector is a photomultiplier tube.

3. The method of claim 1 further including compensating a deviation of said electron multiplication gain from a calibration gain value by applying a correction factor, calculated as a ratio of said calibration gain value to said electron multiplication gain, to data obtained from said photo-detector.

4. The method of claim 1 wherein said light source is a controllable light source, and the intensity of said controllable light source is adjusted to obtain a desired photon count rate.

5. The method of claim 4 wherein said controllable light source is a light emitting diode.

6. A method for adjusting the electron multiplication gain of a photo-detector to maintain said photo-detector operation at a calibration gain value utilizing a light source, the method comprising measuring light from said light source by said photo-detector using photon counting and current integration measurement modes to obtain both a photon count and a current integral, and adjusting said electron multiplication gain to obtain a ratio of said current integral to said photon count that corresponds to said calibration gain value.

7. The method of claim 6 wherein said photo-detector is a photomultiplier tube.

8. The method of claim 6 wherein said light source is a controllable light source, and the intensity of said controllable light source is adjusted to obtain a desired photon count rate.

9. The method of claim 8 wherein said controllable light source is a light emitting diode.

10. The method of claim 8 wherein adjustment of said controllable light source and adjustment of said electron multiplication gain is repeated at least once.

11. Electronic circuit means for determining the electron multiplication gain of a photomultiplier tube as a ratio of integrated current to photon counts, wherein said electronic circuit means both counts incident photons and integrates output current from said photomultiplier tube under illumination from a light source, said electronic circuit means including a high frequency transimpedance amplifier that converts said output current to a voltage in a manner that preserves output pulses resulting from said incident photons, a comparator and a pulse counter which determine said photon counts by counting said output pulses, circuits that integrate said voltage to determine said integrated current, and a high-voltage power supply for operation of said photomultiplier tube.

12. Electronic circuit means of claim 11 further including a high-voltage power supply driver for controlling said high-voltage power supply in order to control said electron multiplication gain of said photomultiplier tube, for the purpose of adjusting said electron multiplication gain to maintain said photomultiplier tube operation at a calibration gain value.

13. The electronic circuit means of claim 11 wherein said light source is a controllable light source, said electronic circuit means further including a light source driver for controlling said controllable light source to obtain a desired light intensity as determined by a measured photon count rate.

14. A device for reading luminescent phosphors which utilizes a photomultiplier tube to measure light emission from said luminescent phosphors and a light source for calibration of electron multiplier gain of said photomultiplier tube, wherein light from said light source incident on said photomultiplier tube is measured using photon counting and current integration measurement modes to obtain both a photon count and a current integral, and said electron multiplication gain is set to a calibration value by adjusting high voltage to said photomultiplier tube so that a ratio of said current integral to said photon count corresponds to said calibration value.

15. The device of claim 14 wherein said light source is a controllable light source, and wherein intensity of said controllable light source is adjusted to obtain a desired photon count rate as measured by said photomultiplier tube.

* * * * *